US005275110A

United States Patent [19]

Flatau

[11] Patent Number: 5,275,110

[45] Date of Patent: Jan. 4, 1994

[54] VENTED PROJECTILE

[76] Inventor: Abraham Flatau, 2004 Stockton Rd., Joppa, Md. 21085

[21] Appl. No.: 845,932

[22] Filed: Apr. 10, 1986

Related U.S. Application Data

[63] Continuation of Ser. No. 622,904, Jun. 21, 1984, abandoned.

[51] Int. Cl.[5] ..... F42B 10/34

[52] U.S. Cl. ..... 102/503; 102/509

[58] Field of Search ..... 102/501, 503, 507–509, 529

[56] References Cited

U.S. PATENT DOCUMENTS 590,428 9/1897 Bennett ..... 102/503

FOREIGN PATENT DOCUMENTS 2856286 7/1980 Fed. Rep. of Germany ..... 102/503
468310 7/1914 France ..... 102/503
20752 6/1919 France ..... 102/503
22394 7/1921 France ..... 102/503

*Primary Examiner*—Harold J. Tudor
*Attorney, Agent, or Firm*—Anthony T. Lane; Edward Goldberg; Michael C. Sachs

[57] ABSTRACT

A small arms projectile containing a series of vents or apertures in a geometric arrangement such that the projectile's leading edge is capable of penetrating the target without structural failure and depositing the majority of its residual energy in the target. In addition, the design of the body allows the projectile to be spin stabilized when fired from any suitable weapon.

1 Claim, 2 Drawing Sheets

VENTED PROJECTILE

GOVERNMENTAL INTEREST

The invention described herein may be manufactured, used and licensed by the Government for governmental purposes without the payment to me of any royalties thereon.

This application is a continuation of application Ser. No. 622,904, filed Jun. 21, 1984 now abandoned.

BACKGROUND OF THE INVENTION

1. Field of the Invention

This invention relates to ammunition. More specifically, this invention relates to either a projectile comprising a hollow body which opens when fired from a gun or a conventional solid base projectile. A series of vents or apertures are placed in the projectile body such that very rapid energy deposition occurs upon entering the target, yet the projectile is capable of maintaining structural integrity during launch, flight, and in the initial process of material penetration into the target.

2. Description of the Prior Art

Tubular or hollow projectiles have long been known in the art. They have not been widely adopted for small arms use, although they have shown promise in terminal ballistic performance.

Generally, tubular projectiles for small arms of a given caliber are lighter than a conventional commercial projectile of the same caliber. This lighter mass has allowed tubular projectiles to be launched at higher muzzle velocities than a conventional projectile with a reduction in recoil.

However, by reducing the tubular projectile weight, muzzle velocity for a given cartridge case volume could be increased without affecting recoil. What is considered most significant is that my invention produces rapid energy deposit in ballistic gelatin targets, as compared to both conventional projectiles and generic tubular projectiles. Further, this invention may be applied to conventional solid base projectiles and produce a similar rapid deposition of energy in the target.

SUMMARY OF THE INVENTION

It is an object of the present invention to provide a tubular projectile capable of being fired from a small arms weapon.

It is a still further object of the present invention to provide a tubular projectile capable of being fired from a small arms weapon and to deposit the majority of its energy in the target.

It is another object of the present invention to provide a tubular projectile capable of being able to penetrate light protective materiel when fired from a small arms weapon and then being able to deposit its residual energy in the target.

It is another object of the present invention to provide a tubular projectile capable of being able to reduce the weight of the projectile by means of a series of vents or apertures in the body, and thereby increase the muzzle velocity without affecting terminal ballistic performance.

A further object of the present invention is to provide A tubular projectile capable of being able to utilize the design of the vents or apertures to increase the manner and rate of energy deposition in target without affecting the projectiles structural integrity during launch, flight, and in the initial process of target penetration.

It is yet another object of the present invention to provide a conventional solid base projectile having a series of vents or apertures which can produce rapid energy deposit in the target.

Although there has been periodic interest in tubular or hollow projectiles, since Whitworth's disclosure in 1856, no apparent progress has been made in applying these configurations to small arms.

Tubular projectiles for small arms use present a variety of technical challenges, ranging from weapon system ammunition feeding through terminal ballistics. While the terminal ballistic performance potential is attractive, there are disadvantages also. Among them is the need for a pusher-obturator during the in-bore launch process.

One of the main requirements for a small arms projectile is the ability to deposit all, or the majority, of its kinetic energy in the target. Yet the projectile should have the structural capability to penetrate various protective barriers, such as Kevlar based body armor or light material such as thin metal sheets or panels, and sufficient residual energy to be effective within the target itself.

At first glance, these requirements would seem dichotomous; that is, to not overpenetrate the unprotected target, yet be able to defeat a protected target. While conventional projectiles either overpenetrate the unprotected target, or fail to penetrate the protective material, my invention provides a unique dual capability in that the inventive projectile can penetrate light material protective barriers, retain its structural integrity, and then deposit its residual energy in the target, as well as depositing all or the majority of its kinetic energy in the unprotected target.

Additionally, the projectile shaping allows for the selection of a larger caliber since the inventive projectile is lighter in weight than its conventional counterpart. This also allows the inventive lighter weight projectile to be fired at a higher muzzle velocity without any increase in recoil over conventional ammunition, yet producing higher kinetic energy, both in flight and it impact.

The rationale underlying subject invention is as follows. Rarely does a small arms projectile enter the target at a perfect angle; that is, without any angle of yaw or pitch. It has been observed that after the projectile is fully immersed in the target, such as ballistic gelatin, and still moving forward a cavity is formed around and behind the projectile.

It is during the entry process that my invention initiates its effectiveness. As the inventive projective projectile enters the ballistic gelatin at some small angle, the vent nearest or foremost in the direction of flight acts as a scoop and allows the gelatin to enter. Because of the vent angle and vent position relative to the projectile body axis (and the axis of rotation), the gelatin entering the vent causes a reaction force on the body which results in a moment about the transverse axis of the projectile body. This angular momentum during the complete entry process causes the projectile to initiate a turning or tumbling motion thus decelerating the projectile and transferring or depositing more of the projectile energy into the target.

Further, the gelatin material ingested by the hollow leading nose section during entry can also interact with the gelatin material entering the vent and add to the deceleration and energy deposit in the target. The use of vents or apertures near the projectile's nose to produce increased energy deposition in the target is also applicable to conventional solid base projectiles.

Proof that the vents produce angular momentum of this type on conventional projectiles was shown by a series of experiments in which a number of projectiles were fabricated of uniform material to the external contour of the standard cal. 45 ball projectile. A hole was drilled along the axis of symmetry without perforating the base of the projectile. Then swept back vents were made in the configuration suggested by FIG. 4. These vented bull type cal. 45 projectiles were fired into ballistic gelatin at short range. In each test, the projectile did not overpenetrate the gelatin block and came to rest in a tail-first attitude in the block. By contrast, standard cal. 45 projectiles fired at the same short range readily overpenetrated the gelatin block and exited the block with as much as 50% to 60% of its initial impact kinetic energy. Thus, for limited or special use, a conventional, solid projectile may be modified to include the vents without making an axial hole completely through the projectile (like a tubular), when it is desirable to deposit maximum energy in the target.

The combination of vents and a central axial passage, continuous or non-continuous in a projectile, produces rapid deceleration in ballistic gelatin by means of energy (momentum) transfer. This is the result of the projectile's angular attitude which then transfers and deposits more energy in the target as well as causing a large cavity wound track.

DESCRIPTION OF THE PREFERRED EMBODIMENTS

An understanding of this invention may be had from the drawings.

Figure 1:
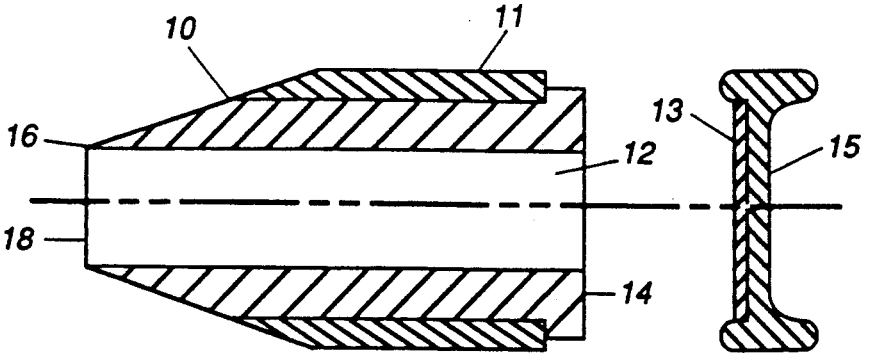
FIG.1 (PRIOR ART)
FIG. 1 is a cross-sectional view of a small arms tubular projectile suitable for use in practicing this invention, but without incorporating the inventive concept.

FIG. 1 shows a tubular projectile 10 having rotating bands 11 positioned to interact with rifling in a gun barrel and force the projectile to spin about a center longitudinal axis of rotation. To prevent the propellant gases from leaking through the central passage 12 a pusher disc 13 is placed in contact with the projectile base 14. The pusher disc 13 is enclosed in a plastic obturator 15 to more fully seal off the propellant gases. The pusher-obturator fits as a unit around the entire projectile base 14. Upon muzzle exit, the pusher 13 and obturator 15 separate from the projectile 10, allowing the projectile to continue its flight toward the target.

Upon impact with the target, the sharp beveled leading edge 16 is readily able to penetrate light protective material, whether of metallic type or soft-body armor, such as Kevlar. Extensive experimental firings have shown that the penetration process tends to reduce the projectile's spin because of friction with the protective material. Thus, the projectile's gyroscopic stability is reduced and upon target entry the change of media density results in a gyroscopic reaction which produces a curved trajectory which further increases the energy transferred from the projectile to the target.

In the case of unprotected targets, the initially higher gyroscopic stability at impact tends to result in slightly longer depth of penetration, though the curved internal path is still evident.

Figure 2:
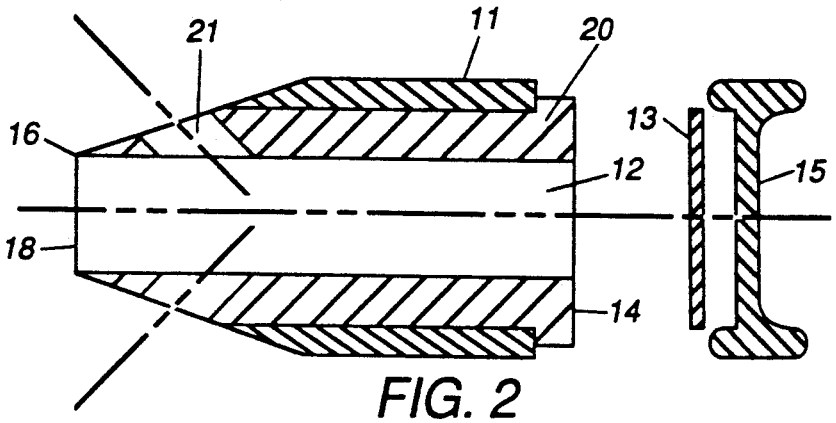
FIG. 2 is a cross-sectional view of the structure in FIG. 1, but incorporating the invention in this case.

FIG. 2 shows a tubular projectile 20 incorporating the inventive concept. In this figure, the projectile has vents 21 uniformly spaced circumferentially around the beveled forward portion of the projectile just behind the leading edge 16. While FIG. 2 shows four angled vents, tests have been conducted with three uniformly spaced vents with good terminal effects. However, it is preferred to have four vents as this provides one swept back vent for each quadrant of rotation, thereby presenting a vent for each ninety degrees of rotation upon target entry. It is understood that trade-offs must be made between the number of vents, vent diameter, and angle of vent. Tests have shown that four vents at an angle of 45 degrees or greater offer excellent terminal ballistic performance. The inclusion of the vents 21 does not affect the tubular projectile's structural strength during penetration of protective materials, bearing in mind that projectile entry into a target is rarely at a perfect angle. The projectile usually enters at some angle of yaw or pitch relative to the front surface of the target. Thus, upon entry into media such as ballistic gelatin, the foremost vent 21 tends to act as an angled scoop, which produces an angular momentum reaction tending to destabilize or tumble the projectile. Concurrently, the gelatin material entering the hollow nose section 18 meets the gelatin material flowing through the vent 21 and into the main channel 12. This jamming up of gelatin material also acts to decelerate the projectile and increases the transfer of energy from the projectile into the target.

Figure 3:
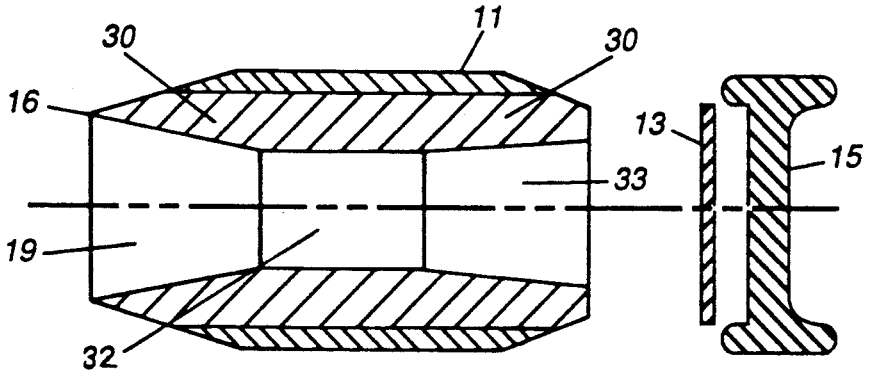
FIG.3 PRIOR ART
FIG. 3 is a cross-sectional view corresponding to FIG. 1 but showing a different projectile not incorporating the invention herein.

Another form of tubular projectile is shown in FIG. 3. Its design varies significantly from the projectile design in FIG. 1. Principal design differences are in the leading edge and in the geometry of the hollow channel 12. The channel consists of convergent initial section 19 rather than a constant diameter channel 18 as in FIG. 2, a constant diameter throat section 32 and a divergent section 33 in the rear of the projectile. This projectile body 30 has a geometry based on that shown in U.S. Pat. No. 4,301,736 but has a projectile length to body diameter less than the 2.5 to 1 ratio of referenced patent.

Figure 4:
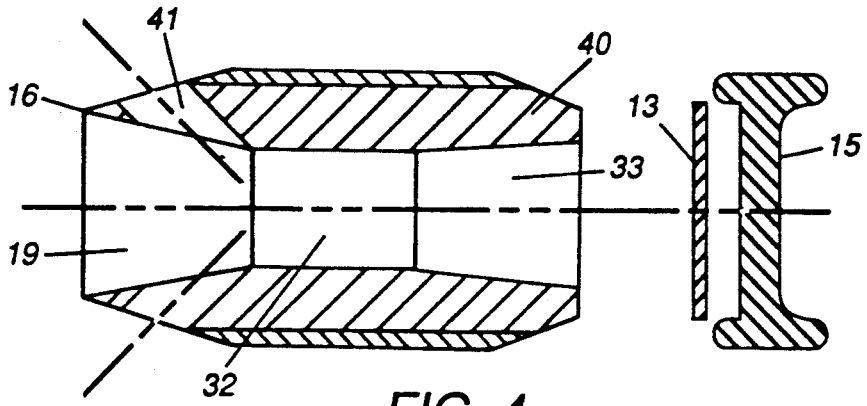
FIG. 4 is a cross-sectional view of the structure of FIG. 3 but incorporating the inventive concept herein.

A second embodiment is shown in FIG. 4. In this embodiment, the projectile of FIG. 3 has been adapted to include a series of angled vents 41 uniformly spaced circumferentially around the tapered or beveled forward portion of the projectile just behind the leading edge 16. When projectile 40 enters ballistic gelatin, the vent 41 act in a manner similar to that described for projectile 20 of FIG. 2.

Figure 5:
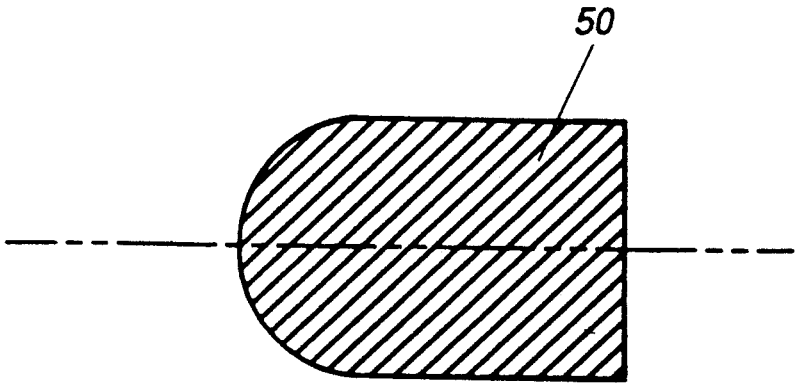
FIG.5 (PRIOR ART)
FIG. 5 is a cross-sectional view of a conventional ball projectile for a caliber .45 standard pistol, representing prior art.
Figure 6:
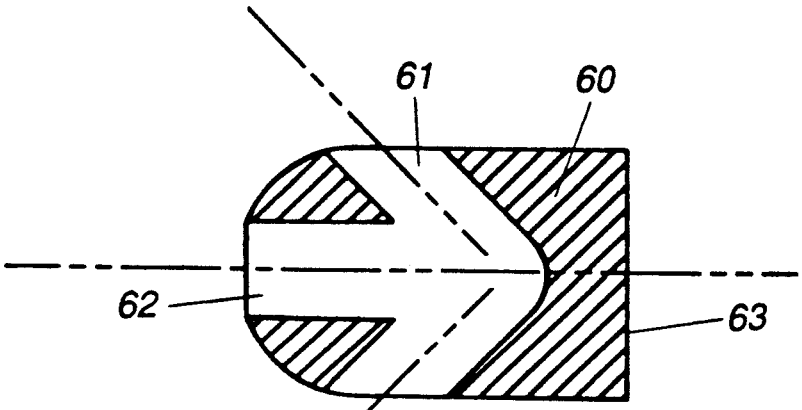
FIG. 6 is a cross-sectional view of the round from FIG. 5 but incorporating the invention herein.

In yet a third embodiment, the conventional .45 caliber conventional ball projectile 50 of FIG. 5 was modified to include inventive features in FIG. 6 with vents 61 uniformly spaced circumferentially around the forward portion of projectile 60 and a hollow nose 62 which does not continue through the spin axis, but terminates in an intersection with the vents 61 such that the solid base 63 of projectile 60 is left with structural integrity. The effect of the vents 61 and its interaction with the hollow nose 62 was experimentally verified by firing a series of modified projectiles into ballistic gelatin. In each test, the projectile 60 did not overpenetrate the ballistic gelatin block as is the case with the conventional projectile 50, but the inventive projectile 60 came to rest in a tail-first attitude, thus showing the angular attitude change induced by the vents 61.

Unlike hollow point or dum-dum projectiles which are dependent upon structural deformation to produce terminal effects, my invention is based on a non-deforming projectile capable of energy deposit in the target by means of angular momentum transfer combined with rapid deceleration.

Figure 7:
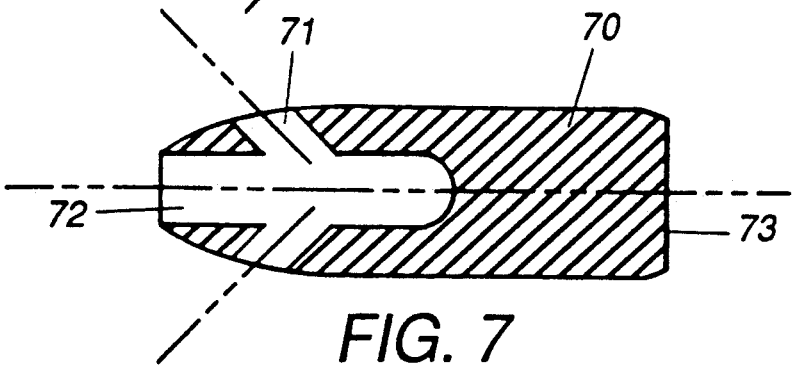
FIG. 7 is a cross-sectional view of a conventional rifle projectile configuration modified to incorporate the invention in this case.

A conventional projectile adapted for a fourth embodiment is shown in FIG. 7. In this embodiment, the vents 71 are uniformly spaced circumferentially around the forward portion of projectile 70 and a hollow nose 72 extends into projectile body 70 but stops short of the projectile base 73. The vents 71 intersect the central hollow channel.

Figure 8:
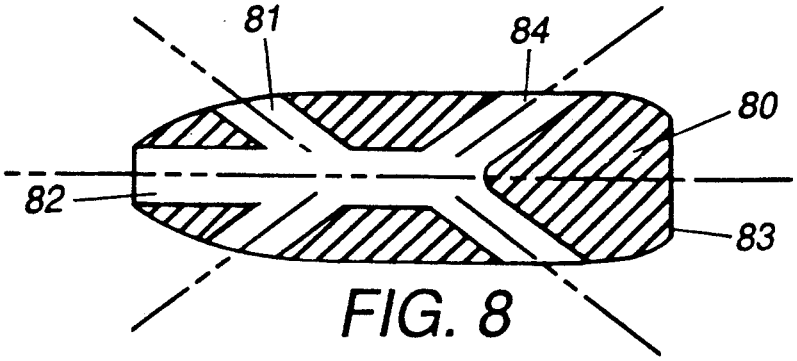
FIG. 8 is a cross-sectional view corresponding with FIG. 7 but incorporating a modification of the invention in this case.

A fifth embodiment of this invention is shown in FIG. 8, wherein a conventional projectile 80 has vents 81 uniformly spaced circumferentially, around the forward portion of the projectile body 80 combined with a hollow nose channel 82 along the longitudinal axis of the projectile. A series of exit ports 84 are uniformly and circumferentially spaced forward the rear of projectile 80. Ports 84 are intended to allow airflow taken in by nose channel 82 and vents 81 to exhaust to the atmosphere during the projectile's flight to the target, thus reducing the aerodynamic drag.

It should be noted that the introduction of venting and the central hollow channel results in a significant reduction in the projectile weight. This allows the interior ballistics of the gun system to launch the lighter projectile at a higher muzzle velocity without any increase in the recoil. Further, the higher initial velocity tends to overcome at shorter range the additional drag which may be created by the vents and central hollow channel, particularly in the embodiments of FIGS. 6 and 7 where the central channel does not continue through the entire body length.

What is claimed is:

1. A projectile for small arms ammunition to be fired from a small caliber gun at a lightly protected target consisting of:

an elongated tubular body provided with a forward end and a rear end all of which is symmetrical about a center axis, a center axial hole passing through the entire length of said body and symmetrical about said center axis, a plurality of hollow venting straight passages in spaced radial relationship around said body, and each of said passages in said forward end having an entrance in an outer surface of said body, and an exit communicating with said center hole, and each of said passages longitudinally directed inwardly towards the rear end and oriented on an axis angularly displaced at least 45° from said longitudinal center axis, whereby a rapid energy deposition occurs upon entering said target without overextending the same.

* * * * *